US005089065A

United States Patent [19]

Hamano et al.

[11] Patent Number: 5,089,065

[45] Date of Patent: Feb. 18, 1992

[54] MELT-QUENCHED THIN-FILM ALLOY FOR BONDED MAGNETS

[75] Inventors: Masaaki Hamano, Sendai; Hiroshi Yamamoto, Tokyo; Mitsuru Nagakura, Yokohama; Yoshiaki Ozawa, Tokyo, all of Japan

[73] Assignee: MG Company Ltd., Miyagi, Japan

[21] Appl. No.: 396,674

[22] Filed: Aug. 22, 1989

[30] Foreign Application Priority Data

Aug. 23, 1988 [JP] Japan ..... 63-207312

[51] Int. Cl.[5] ..... H01F 1/053

[52] U.S. Cl. ..... 148/302; 420/83; 420/121; 428/606

[58] Field of Search ..... 148/302; 420/121, 83; 428/606

[56] References Cited

U.S. PATENT DOCUMENTS 4,765,848 8/1988 Mohri et al. ..... 148/302

FOREIGN PATENT DOCUMENTS 0175222 3/1986 European Pat. Off. ..... 148/302
0242187 10/1987 European Pat. Off. ..... 148/302
0258609 3/1988 European Pat. Off. ..... 148/302
57-141901 9/1982 Japan .
58-123853 7/1983 Japan .
59-46008 3/1984 Japan .
59-219453 12/1984 Japan .
60-100402 6/1985 Japan .

*Primary Examiner*—John P. Sheehan
*Attorney, Agent, or Firm*—Birch, Stewart Kolasch & Birch

[57] ABSTRACT

A melt-quenched thin-film alloy indicated by the alloy composition formula $$R_XFe_{100-(X+Y+Z+W)}Co_WB_YV_Z$$

wherein: R represents Nd alone or a composite rare earth element containing at least 50 atomic % of Nd, where the atomic precentages being $9 \leqq X \leqq 12$, $6 \leqq Y \leqq 10$, $0.5 \leqq Z \leqq 3$ and $5 \leqq W \leqq 16$; and a process for producing a melt-quenched thin-film of an alloy for a bonded magnet comprising injecting a melt of an alloy indicated by the alloy composition formula $$R_XFe_{100-(X+Y+Z+W)}CO_WB_YV_Z$$

(wherein: R represents Nd alone or a composite rate earth element containing at least 50 atomic % of Nd, where the atomic percentages being $9 \leqq X \leqq 12$, $6 \leqq Y \leqq 10$, $0.5 \leqq Z \leqq 3$ and $5 \leqq W \leqq 16$) via the pressure of an inert gas on the surface of a rolling roll for cooling, and then quenching said melt.

11 Claims, No Drawings

MELT-QUENCHED THIN-FILM ALLOY FOR BONDED MAGNETS

This invention relates to a melt-quenched thin-film alloy for a bonded magnet basically comprising a so-called rare earth element - iron - boron type.

Heretofore, as a permanent magnet using a rare earth element - iron - boron type alloy, according to the classification of methods of production, the following three kinds have been known.

(1) Sintered magnets produced by a power metallurgy processing (for example, Japanese Laid-Open Patent Publications Nos. 46008/1984 and 219453/1984).

(2) Bonded magnets (resin-bonded magnets) produced by using magnet powders obtained by a melt-quenched thin-film producing method (for example, Japanese Laid-Open Patent Publications Nos. 141901/1982 and 123853/1983).

(3) Hot processed magnets obtained by applying hot-compression stress at least once to said thin-film magnet powders of said (2), above (for example, Japanese Laid-Open Patent Publication No. 100402/1985).

The magnets of categories (1) and (3), above may become anisotropic magnets, however, the magnets of category (2), above are industrially produced only as isotropic magnets, accordingly, magnets having low magnetic energy. In order to obtain anisotropic magnets from the magnets of (2), above, a method was proposed to pulverize the anisotropic magnets of (1) or (3), above, to produce anisotropic magnet powders, thereafter making bonded magnets out of these powders was proposed, but such a method has not been carried out on an industrial scale yet.

Bonded magnets are molded magnets produced with resins being used as binders for the magnet powders, that are roughly divided into two groups of compression-molded magnets produced with a thermosetting resin used as a binder and injection-molded magnets produced with a thermoplastic resin being used as a binder; besides these two, there is an extrusion-molded magnet. Because the bonded magnets generally contain as much as 15 to 50 % by volume of resins that are regarded as magnetic impurities, they exhibit low magnetic properties as a natural consequence. Nevertheless, other industrial advantages of these magnets are recognized, for example, they can be mass produced, they can assume optional shapes, they have high dimensional precision and they can be easily made into composite parts by integral molding such as insert molding, outsert molding and two color molding. The output of bonded magnets using various magnet powders has been on a marked increase in recent years.

As mentioned above, bonded magnets using an alloy basically comprising a rare earth element - iron-boron have been isotropic to date and their magnetic energies are at most 6 MGOe in the case of the injection molded magnets and at most 10 MGOe in the case of the compression molded magnets, which are the upper limits of these types of the bonded magnets, respectively. On the other hand, however, isotropic magnets have their own merits in other aspects, for example, they do not require processes for orientation such as molding under the magnetic field, that facilitates production of molds, they have fewer qualitative dispersions, in addition, they are low-cost and suitable for mass production, besides, they have various excellent industrial merits inherent to bonded magnets as mentioned above.

Accordingly, if the magnetic properties that are the shortcomings of such isotropic bonded magnets can be improved and advanced, it would raise the cost performance thereof (i.e. the magnetic energy/the production cost), and it could contribute greatly to an increase in industrial output.

An object of this invention is to enable isotropic bonded magnets to be provided as excellent industrial products by advancing the magnetic properties of a melt-quenched thin-film alloy for (the production of) isotropic bonded magnets.

To realize a melt-quenched thin-film alloy having excellent magnetic properties which is an object of this invention, the following technical means are adopted in this invention.

Namely, the present inventors have found that when the composition of an alloy basically comprising a rare earth element iron and boron as principal components is selected as follows, the aforesaid object is attained and a bonded magnet having excellent magnetic properties is obtained.

Thus, this invention provides a melt-quenched thin-film alloy for bonded magnets the composition of which shown by the following formula of an alloy composition:

$$R_XFe_{100-(X+Y+Z+W)}Co_WB_YV_Z$$

(wherein:

R represents Nd alone or composite rare earth elements containing at least 50 atomic % of Nd, and the atomic percentages are $9 \leqq X \leqq 12$, $6 \leqq Y \leqq 10$, $0.5 \leqq Z \leqq 3$and $5 \leqq W \leqq 16$.) The composition may include such impurities that are unavoidable in the production processes.)

The conventional melt-quenched thin-film magnetic powders for bonded magnets are supplied exclusively by General Motors Corp. of the U.S.A., and isotropic bonded magnets produced by using these magnetic powders have magnetic properties of at most 10 MGOe in the case of the compression molded magnets and at most 6 MGOe in the case of the injection molded magnets.

This invention is based on the discovery of an excellent composition of a melt-quenched thin-film alloy having a residual flux density $Br \geqq 9$ KG, a coercive force $iHc \geqq 8$HOe and a magnetic energy $(BH)_{max} \geqq 17$MGOe, by far surpassing the performances of the conventional product as a result of extensive scrutiny of the compositions of melt-quenched thin-film alloys. And as will be seen from Examples shown below, this invention makes it possible to provide isotropic bonded magnets having high magnetic properties and high productivity.

The melt-quenched thin-film alloy of this invention may be produced by a conventional known method. A melt-quenched thin-film is generally obtained by quickly changing a temperature at which an alloy is in a molten state to a temperature at which the alloy is solidified, and typically a production method called melt spinning may be used. This method comprises, for example, injecting a high frequency electric current-dissolved alloy from a quartz nozzle to the surface of a roll for cooling which is rotating at a circumferential speed of tens of meters per second via the pressure of a gas such as argon, thereafter quenching the melt to obtain an about 10 mm wide, tens of microns thick ribbon-shaped or powdery melt-quenched thin-film. The X-ray diffracted state of the resulting thin film is amorphous when the quenching speed is fast and crystalline when the quenching speed is slow.

A melt-quenched thin-film exhibiting good magnetic properties in this invention is in an intermediate state in X-ray diffraction micrography, namely, a state wherein a plurality of crystalline particles of a particle diameter of hundreds to thousands of Å are present. In order to attain this state, there are two methods, one is a method wherein the aforesaid state of the particles are realized as a quenched state itself by suitably adjusting the quenching speed, and the other is a method of precipitating minute crystals by heat treating the thin film obtained by quenching the film until it becomes amorphous, i.e., an over-quenched state, at an appropriate temperature, and either one of these two methods is applicable in this invention.

The resulting melt-quenched thin-film is then pulverized to an appropriate particle diameter (meshes), and used as a raw material for producing bonded magnets.

Next, an explanation will be made with reference to the composition of the alloy in this invention The composition of the alloy in this invention is basically based on the discovery of high magnetic properties exhibited, when the composition of an alloy basically comprising a ternary composition of a rare earth element - iron - cobalt, for example typically represented by $Nd_{15}Fe_{88}B_7$ is improved. Namely, by making a melt-quenched thin-film of a 5-component alloy obtained by further adding cobalt (Co) and vanadium (V) to the ternary alloy of a rare earth element - iron - cobalt, high magnetic properties are found in the resulting 5-component melt quenched thin-film alloy. However, in the aforesaid ternary or 5-component alloy, when at least two rare earth elements are used in combination, they are counted as one component, not two or more.

In this invention, R means Nd alone or composite rare earth elements containing at least 50 atomic % of Nd. The composite rare earth elements may be, for example, $Nd_{100-U}Pr_U$ (wherein U is $50>U>0$ in atomic percentage) or it may be what.contains at least 50 atomic % of Nd such as so-called didymium alloy and cerium-didymium alloy. The reason why the amount of Nd is limited to not less than 50 atomic % is because when Nd content is less than 50 atomic %, such a high magnetic energy in excess of 17 MGOe is not realized.

Vanadium (V) is a kind of Va group metals in addition to Nb and Ta, but addition of Nb or Ta did not result in bringing about such high magnetic properties as shown by this invention. Accordingly, this invention requires V only among the other Va group metals as an essential component. However, as raw materials providing a V element, low-purity V metals and ferrovanadium (primarily of Fe - V) may be used as well, and in this case, as impuirty elements, for example, Si, Al and C may be contained in a total amount of less than 5 %. These unavoidable impurities are to be included within the scope of this invention. And impurities contained in the other components of the alloy and impurities, including even gaseous components such as 0, N and H, which are inevitably mixed in the process for preparing the melt-quenched thin-film, are to be also included within the scope of this invention.

Next, an explanation will be made with reference to the restrictions of the numerical values of the respective atomic percentages X, Y, Z and W of the rare earth element (R), boron (B), vanadium (V) and cobalt (Co), respectively, based on the alloy composition formula mentioned above.

When X is less than 9, lowering of the residual flux density, hence, lowering of the magnetic energy is remarkable, and when X exceeds 12, the coercive force lowers markedly due to appearance of a soft magnetic phase, and the magnetic energy also lowers. When Y is less than 6, the coercive force is low, and when Y exceeds 10, the residual flux density lowers due to appearance of a non-magnetic phase. Even if Z is less than 0.5, the alloy exhibits considerably high magnetic properties, but not sufficient enough, and when Z exceeds 3, the residual flux density lowers markedly. Further, when W is less than 5, the Curie temperature does not rise markedly, basides the simultaneous advancement of the residual flux density and the coercive force due to the composite effect of addition of Co and V in combination, which is one of the characteristics of this invention is not attained adequately. When W exceeds 16, the lowering of the residual flux density is remarkable as a main adverse effect.

As mentioned above, one of the characteristics of this invention reside in obtaining an excellent isotropic melt-quenched thin-film alloy for bonded magnets due to the composite effect of addition of Co and V in combination, in the magnetic properties of the resulting melt-quenched thin-film of the 5-component alloy R-Fe-Co-B-V , the residual flux density is markedly advanced to at least 9 kG, the coercive force iHc is markedly advanced to at least 8 kOe and the magnetic energy $(BH)_{max}$ is markedly advanced to at least 17 MGOe as a result. Accordingly, in this invention, both Co and V are indispensable as the alloy components, and lack of either one of these two components does not give a melt-quenched thin-film alloy having an adequately excellent magnetic energy.

This invention provides an isotropic melt-quenched thin-film alloy for bonded magnets, but when a magnetic field for orientation is impressed upon producing bonded magnets, a slight advancement of the magnetic properties of the resulting bonded magnets is occasionally recognized.

Further, it is needless to say that it is possible to produce a bulk-type metal magnet imparted with isotropic or anisotropic property obtained by applying a hot compression stress such as a hot press using this alloy or produce anisotropic bonded magnets using the powders of such metal magnet.

The following examples illustrate this invention more specifically.

[EXAMPLE 1]

Various alloys having compositions shown in Table 1 were dissolved with a high frequency electric current to obtain alloy ingots. These alloys were coarsely pulverized, placed in quartz injection pipes, again dissolved with a high frequency electric current, then by the gaseous pressure of argon, injected to the surface of a chromium-plated copper roll (roll diameter 150 mm) via orifices (each having a diameter of 0.5 mm), and then quenched. As a result of conducting various experiments, the circumferential speed of the roll was preferably set at about 17 m/sec.

The resulting melt-quenched thin-films were ribbon-like shapes having widths of about 1 mm and thicknesses of 20 to 30 microns (μm). After the resulting melt-quenched thin-films were pulse-magnetized (50 kOe), their magnetic properties were measured by a vibrating sample magnetometer (VSM).

After effecting a demagnetization factor amendment, the magnetic properties measured of the melt-quenched thin-films are shown in Table 1. In Table 1, sample No. 7 is a comparative example.

From Table 1, it is appreciated that the melt-quenched thin-films having high the magnetic properties including the magnetic energies $(BH)_{max}$ exceeding 17 MGOe within suitable ranges of the vanadium compositions are obtained. In addition, as compared with comparative example, both the residual flux density Br and the coercive force iHc advance.

When the melt-quenched thin-film of sample No. 4 was pulverized to a particle diameter of less than 150 μm (microns) to produce isotropic compression molded (bonded) magnet containing 15 % by volume of an epoxy resin, the magnetic properties thereof exhibited high values including the magnetic energy of 12.3 MGOe. Further, when an isotropic bonded magnet containing 37 % by volume of a nylon resin was produced by injection molding, it exhibits a high magnetic energy of 7.4 MGOe.

TABLE 1

| No. | Alloy composition (atomic percentage) | Magnetic properties Br (kG) | iHc (kOe) | (BH) max (MGOe) |
|---|---|---|---|---|
| 1 | $Nd_{11}Fe_{72}Co_8B_{6.0}V_{3.0}$ | 9.1 | 10.9 | 18.0 |
| 2 | $Nd_{11}Fe_{72}Co_8B_{6.5}V_{2.5}$ | 9.3 | 11.7 | 18.4 |
| 3 | $Nd_{11}Fe_{72}Co_8B_{7.0}V_{2.0}$ | 9.4 | 12.3 | 18.7 |
| 4 | $Nd_{11}Fe_{72}Co_8B_{7.5}V_{1.5}$ | 9.7 | 12.9 | 20.1 |
| 5 | $Nd_{11}Fe_{72}Co_8B_{8.0}V_{1.0}$ | 9.6 | 12.4 | 19.2 |
| 6 | $Nd_{11}Fe_{72}Co_8B_{8.5}V_{0.5}$ | 9.3 | 10.8 | 18.2 |
| 7* | $Nd_{11}Fe_{72}Co_8B_{9.0}$ | 8.9 | 9.4 | 16.5 |

*Comparative Example

[EXAMPLE 2]

Melt-quenched thin-films were produced of alloys having compositions shown in Table 2 by the same method as in Example 1 and the magnetic properties of the resulting thin-films were measured. The results are also shown in Table 2, In Table 2, samples No. 8 and No. 13 are comparative examples. As will be appreciated from Table 2, when the atomic percentage of Nd is within a suitable range, preferable high magnetic properties including the magnetic energies exceeding 17 MGOe are obtained.

The magnetic energies of the compression molded (bonded) magnet produced by using the melt-quenched thin-film alloy of sample No. 10 and that of the injection molded (bonded) magnet produced by using the same alloy were 12.1 MGOe and 7.0 MGOe, respectively.

TABLE 2

| No. | Alloy composition (atomic percentage) | Magnetic properties Br (kG) | iHc (kOe) | (BH) max (MGOe) |
|---|---|---|---|---|
| 8* | $Nd_8Fe_{73}Co_{10}B_{7.5}V_{1.5}$ | 8.8 | 10.3 | 15.5 |
| 9 | $Nd_9Fe_{72}Co_{10}B_{7.5}V_{1.5}$ | 9.2 | 12.1 | 18.2 |
| 10 | $Nd_{10}Fe_{71}Co_{10}B_{7.5}V_{1.5}$ | 9.6 | 12.8 | 19.8 |
| 11 | $Nd_{11}Fe_{70}Co_{10}B_{7.5}V_{1.5}$ | 9.5 | 12.9 | 19.4 |
| 12 | $Nd_{12}Fe_{69}Co_{10}B_{7.5}V_{1.5}$ | 9.4 | 10.8 | 18.7 |
| 13* | $Nd_{13}Fe_{68}Co_{10}B_{7.5}V_{1.5}$ | 9.0 | 8.7 | 16.1 |

*Comparative Examples

[EXAMPLE 3]

Melt-quenched thin-films were produced of alloys having compositions shown in Table 3 by the same method as in Example 1, and the magnetic properties of the resulting thin-films were measured. The results are shown in Table 3. In Table 3, samples No.14 and No. 21 are comparative examples.

As will be appreciated from Table 3, even when the range of atomic percentages of Co is relatively broad, the preferable magnetic properties are retained.

The magnetic energies of the compression molded (bonded) magnet and the injection molded (bonded) magnet produced by using the melt-quenched thin-film of sample No. 16 were 12.2 MGOe and 7.1 MGOe, respectively.

TABLE 3

| No. | Alloy composition (atomic percentage) | Magnetic properties Br (kG) | iHc (kOe) | (BH) max (MGOe) |
|---|---|---|---|---|
| 14* | $Nd_7Pr_3Fe_{78}Co_4B_7V_1$ | 8.9 | 10.6 | 16.6 |
| 15 | $Nd_7Pr_3Fe_{76}Co_6B_7V_1$ | 9.4 | 11.8 | 18.8 |
| 16 | $Nd_7Pr_3Fe_{74}Co_8B_7V_1$ | 9.8 | 13.0 | 20.3 |
| 17 | $Nd_7Pr_3Fe_{72}Co_{10}B_7V_1$ | 9.7 | 13.0 | 19.9 |
| 18 | $Nd_7Pr_3Fe_{70}Co_{12}B_7V_1$ | 9.6 | 12.8 | 19.2 |
| 19 | $Nd_7Pr_3Fe_{68}Co_{14}B_7V_1$ | 9.4 | 12.8 | 18.8 |
| 20 | $Nd_7Pr_3Fe_{66}Co_{16}B_7V_1$ | 9.3 | 12.9 | 18.4 |
| 21* | $Nd_7Pr_3Fe_{64}Co_{18}B_7V_1$ | 9.1 | 12.7 | 16.9 |

*Comparative Examples

[EXAMPLE 4]

Using an alloy having the same composition as sample No. 4 in Example 1, a melt-quenched thin-film was produced. The circumferential speed of the roll was made 23.6 m/sec. this time and the sample was over-quenched to the aforesaid amorphous state, then it was subjected to a heat-treatment at 650° C. for 10 minutes to realize the state of precipitating minute crystals. The results of measuring the magnetic properties of the resulting thin-film include $(BH)_{max}=18.6$ MGOe, Br=9.5 kG and iHc=10.4 kOe, thus adequate high property values were obtained.

When this thin-film was pulverized and a bonded magnet was produced, when the bonded magnet produced was an isotropic compression molded magnet, $(BH)_{max}=11.4$ MGOe, and when the bonded magnet produced was an injection molded magnet, $(BH)_{max}=6.8$ MGOe. Thus, in both cases, the bonded magnet had high magnetic energy. For information, the circumferential speed of the roll and the values of the temperature and time of the heat-treatment were one examples after all, and it is necessary to establish appropriate values based on the composition of the alloy and the structure of the quenching apparatus. Accordingly, this example illustrates that even in the case of subjecting the melt-quenched thin-film to a heat-treatment after the over-quenching, according to the composition of the alloy of this invention, it is possible to provide a melt-quenched thin-film having high magnetic properties for a bonded magnet.

Further, various melt-quenched thin-films were provided based on the composition of the alloy described in claim 1 and their magnetic properties were measured, the same effect as in the aforesaid examples, namely, the composite effect due to the simultaneous addition of Co and V in combination developed markedly, and it was confirmed that the magnetic properties sharply advanced according to this invention as compared with the non-added comparative examples.

As mentioned so far, according to this invention, a melt-quenched thin-film of an alloy comprising a rare earth element-iron-cobalt-boron-vanadium has attained sharp advancement of Br, iHc and $(BH)_{max}$ by the simultaneous addition of cobalt and vanadium as compared with the conventional melt-quenched thin-film.

When said melt-quenched thin-film is used, it is possible to provide an isotropic bonded magnet having magnetic properties higher (and better) than those of the conventional (isotropic) bonded magnet. And this melt-quenched thin-film with the advanced magnetic properties has a possibility of being used as a material for magnets of the various other types or morphology.

Accordingly, this invention is expected to make a great contribution in the industrial field of utilizing permanent magnets.

What is claimed is:

1. A melt-quenched thin-film alloy indicated by the alloy composition formula:

$$R_X Fe_{100-(X+Y+Z+W)} Co_W B_Y V_Z$$

wherein R represents Nd alone or a composite rare earth element containing at least 50 atomic % of Nd, and wherein the atomic percentages satisfy the following relationships $9 \leqq X \leqq 12$, $6 \leqq Y \leqq 10$, $0.5 \leqq Z \leqq 1.5$ and $5 \leqq W \leqq 16$, said alloy having a residual flux density of $Br \geqq 9$ KG, a coercive force of $iHc \geqq 8$ HOe and a magnetic energy of $(BH)_{mzx} \geqq 17$ MGOe.

2. The melt-quenched thin-film alloy of claim 1, wherein R represents Nd.

3. The melt-quenched thin-film alloy of claim 1, wherein R represents $Nd_{100-u}Pr_u$, wherein U is atomic percent and satisfies the relationship $50 > U > 0$.

4. The melt-quenched thin-film alloy of claim 1, wherein R represents a didymium or cerium-didymium alloy.

5. The melt-quenched thin-film alloy of claim 3 wherein U is 30.

6. The melt-quenched thin-film alloy of claim 1, wherein Y is in the range of 6.0–8.5.

7. The melt-quenched thin-film alloy of claim 2, wherein Y is in the range of 6.0–8.5.

8. The melt-quenched thin-film alloy of claim 1, wherein W is in the range of 6–16.

9. The melt-quenched thin-film alloy of claim 2, wherein W is in the range of 6–16.

10. The melt-quenched thin-film alloy of claim 1, wherein the atomic percentage of Fe is in the range of 66–76.

11. The melt-quenched thin-film alloy of claim 2, wherein the atomic percentage of Fe is in the range of 66–76.

* * * * *